US006701729B2

(12) United States Patent
Bagley

(10) Patent No.: US 6,701,729 B2
(45) Date of Patent: Mar. 9, 2004

(54) DEVICE AND METHOD FOR OPERATING A REFRIGERATION CYCLE WITHOUT EVAPORATOR ICING

(75) Inventor: Alan W. Bagley, Gilroy, CA (US)

(73) Assignee: BBC Enterprises, Inc., Carson City, NV (US)

( * ) Notice: Subject to any disclaimer, the term of this patent is extended or adjusted under 35 U.S.C. 154(b) by 0 days.

(21) Appl. No.: 10/213,347

(22) Filed: Aug. 5, 2002

(65) Prior Publication Data

US 2004/0000153 A1 Jan. 1, 2004

Related U.S. Application Data

(63) Continuation-in-part of application No. 09/859,829, filed on May 16, 2001, now Pat. No. 6,519,956.

(51) Int. Cl.[7] ..... F25B 47/02

(52) U.S. Cl. ..... 62/156; 62/81; 62/196.4; 62/278

(58) Field of Search ..... 62/151, 155, 156, 62/140, 81, 196.4, 277, 278, 234

(56) References Cited

U.S. PATENT DOCUMENTS

| | | | | |
|---|---|---|---|---|
| 3,368,364 A | | 2/1968 | Norton et al. | |
| 3,498,073 A | | 3/1970 | Kusuda et al. | |
| 4,189,929 A | | 2/1980 | Russell | |
| 4,313,313 A | * | 2/1982 | Chrostowski et al. | 62/196.4 |
| 4,625,524 A | * | 12/1986 | Kimura et al. | 62/278 |
| 4,775,484 A | | 10/1988 | Schmidt et al. | |
| 4,785,640 A | | 11/1988 | Naruse | |
| 5,031,411 A | | 7/1991 | Gehring et al. | |
| 5,183,101 A | | 2/1993 | Penaluna et al. | |
| 5,313,787 A | | 5/1994 | Martin | |
| 5,396,777 A | | 3/1995 | Martin | |

OTHER PUBLICATIONS

"What is a Solenoid?"; http://www.detroitcoil.com/whatis.htm; Mar. 2, 2001; pp. 1–2.
"Valve Operation"; http://wwwgouldvalve.com/anim.htm; Mar. 2, 2001; p. 1.
"Thermocouple Technical Reference Data"; ISE Inc.; http: www.instserv.com/rmocoupl.htm; Mar. 2, 2001; pp. 1.
"Microprocessor"; Encyclopedia.com; http:encyclopedia.com/articles/08444.html; Mar. 2, 2001; pp. 1–4.
"Thermocouple application note"; http://picotech.com/applications/thermocouple.html; Mar. 2, 2001; pp. 1–5.
"Information on Fritted Glass Filters and Mesh Designations"; http://www.adamschittenden.com/FritMesh.html; Mar. 2, 2001; pp. 1–3.
"Reference Materials–Coatings"; Heatcraft; http://www.heatcraftheattransfer.com/resources/coatings2.asp; May 5, 2001; pp 1–2.
"Ozone Generator"; http://tahfin.org/resources/factsheets/ozone.htm; Mar. 2, 2001; pp. 1–2.
"Air Conditioning"; http://dhclimatecontrol.com/ac.htm; Feb. 16, 2001; pp. 1–4.
"Thermal Interface Basics"; http://arcticsilver.com/thermal_interface_basics.htm; May 3, 2001; pp. 1–4.
"GA5–GA10 Flow Diagram"; http://www.edmac.com/flow5–10.htm; Feb. 19, 2001; p. 1.
"Refrigeration Cycle"; http://web.usna.navy.mil/~dgrasdoc/thermo/ref.html; Feb. 21, 2001; pp. 1–2.
"Refrigeration Cycle"; Warmair.com; http:www.warmair.com/html/refrigeration_cycle.htm; Feb. 21, 2001; pp. 1–2.

(List continued on next page.)

*Primary Examiner*—Harry B. Tanner
(74) *Attorney, Agent, or Firm*—Gregory Smith & Associates

(57) ABSTRACT

The present invention relates to a device and method for operating a refrigeration cycle without icing of the evaporative surface of the device.

31 Claims, 3 Drawing Sheets

OTHER PUBLICATIONS

"Principles of Operation"; http://online–product.com/dehumidifier/priciples.html; Feb. 16, 2001; p. 1.

"Compressors"; http://web.usna.navy.mil/~dgrasdoc/thermo/compressor.html; Feb. 21, 2001; pp. 1–2.

"The Basic Refrigerant Cycle"; http://www.hvacwebtech.com/RefrigerantCycle.htm; Feb. 17, 2001; pp. 1–2.

"Compressed Air Glossary of Terms"; Compressed Air Management; http:www.impactrm.com/html/c.html; Feb. 19, 2001; pp. 1–7.

Diagram of Refrigeration Cycle; University of Guelph; http:www/foodsci.ouguelph.ca/deicon/refn.html; Feb. 21, 2001; p. 1.

Tomczyk, John A., "Refrigeration Science & Technology," Hy–Save, www.hysave.co.uk/page4.html, Feb. 17, 2001. pp. 1–8.

"Refrigerants & Charging the Thermostatic Expansion Valve (TXV)," James'A/C. Co., www.longviewweb.com/expansio.htm, Feb. 17, 2001, pp. 1–2.

"Definition of a Heat Pump," Maritime Geothermal Ltd., www.discribe.ca/nordic/hpworks.htm, Feb. 17, 2001, pp. 1–9.

"Refrigeration Cycle," http://filebox.vt.edu/eng/mech/scott/ref.html; Feb. 17, 2001, pp. 1–2.

"TXV Diagnostics," Hoshizaki Care, www.hvacwebtech.com/Hoshizaki.htm; Feb. 17, 2001. pp. 1–5.

Casiday, R. et al., "Phase Changes and Refrigeration: Thermochemistry of Heat Engines," Thermochemistry Experiment; http://wunmr.wustl.edu/EduDev/LabTutorials/Thermochem/Fridge.html; Feb. 21, 2001; pp. 1–11.

"Pumping Heat Uphill," Heat Pumps; http://energyoutlet.com/res/heatpump/pumping.html; Feb.21, 2001; pp. 1–3.

"A/C Compressor Operation," http://www.autoshop–online.com/auto101/ac1.html; Feb. 16, 2001; pp. 1–3.

Refrigeration Cycle:; Home Solutions; http:www.autoshop–online.com/auto101/ac1.html; Feb. 21, 2001; pp. 1–8.

"Theory of Heat Pump Operation"; Center for Excellence Absorption Technology/Heat Pump Theory; http://rcl.eng.ohio–state.edu/~christ–r/ceat/theory/theory.html; Feb. 17, 2001; pp. 1–8.

* cited by examiner

Fig. 3
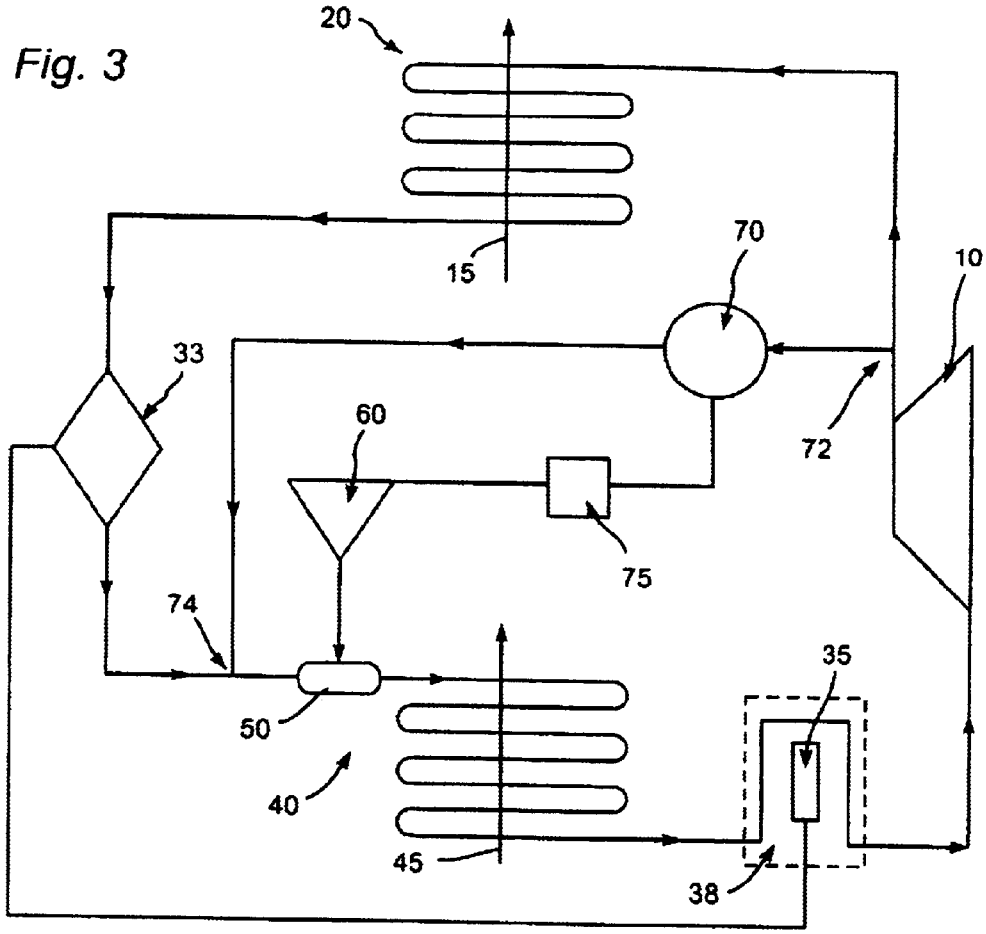
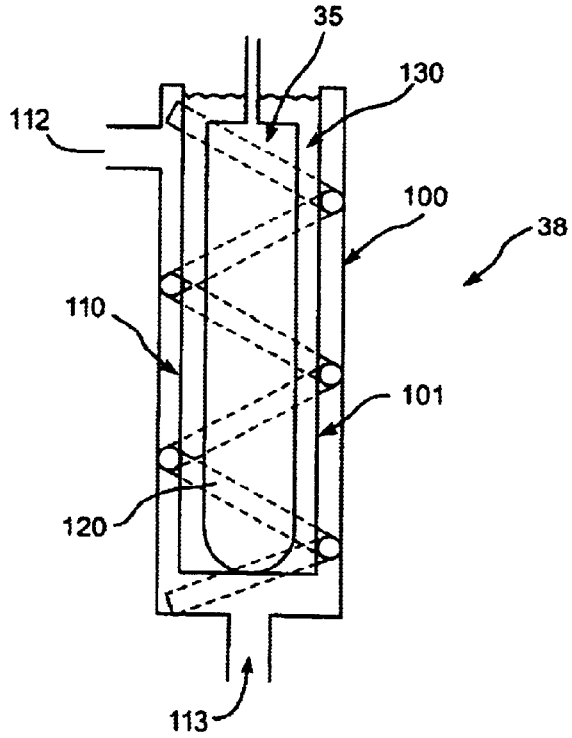
Fig. 4

DEVICE AND METHOD FOR OPERATING A REFRIGERATION CYCLE WITHOUT EVAPORATOR ICING

RELATED APPLICATIONS

This application is a continuation-in-part of application Ser. No. 09/859,829, filed May 16, 2001 U.S. Pat. No. 6,519,956, to Alan W. Bagley, which application is incorporated by reference as if fully set forth, including the drawings, herein.

FIELD OF THE INVENTION

The present invention relates to the fields of mechanics, thermodynamics, fluidics, refrigeration, dehumidification and water collection and purification. In particular, it relates to a device and method for preventing ice formation on the evaporator of a device operating in a refrigeration cycle, particularly at low ambient air temperatures.

BACKGROUND OF THE INVENTION

The refrigeration cycle has numerous uses. One, of course, is refrigeration, the cooling of ambient air in an enclosure to a temperature at or below freezing for the purpose of preventing the spoilage of comestibles such as meat, fresh fruit and fresh produce. Another is building air conditioning. A further use for the refrigeration cycle is removing water from moist air. The purpose may simply be to dry the air as in the case of household dehumidifiers, industrial scale fruit and vegetable dryers and the like. Or the purpose may be to produce potable water for personal household use, camping, public water conservation and the like or for use during emergencies such as earthquakes, floods, fire and other natural disasters or man-made disasters such as war, when the normal water supply is compromised. In any event, the device and method employed is essentially the same and is schematically depicted in FIG. 1.

In FIG. 1, compressor 1 receives a refrigerant gas, such as ammonia, sulfur dioxide, Freon®, and the like, and compresses it, i.e., raises its pressure. As the result of being compressed, the gas heats up, becoming a hot, high pressure, gas. The hot, high pressure gas is then received by condenser 2, which consists of a heat exchanger having a large surface area that is in contact with circulating ambient air. The hot, high pressure gas surrenders some of its heat content to the circulating air and, as a result, is condensed to a liquid which, while still warm, is cooler than the hot gas entering the condenser. The warm, high pressure liquid then travels to metering device 3, which can be a simple orifice, a capillary tube or a thermostatic expansion valve, and which forces the liquid to expand and thereby cool further. The cool liquid then travels to evaporator 4, which, like the condenser, consists of a large surface area over which moisture-containing air can be circulated. The evaporator can be merely a length of tubing that has been folded over on itself in a serpentine manner as depicted in FIG. 1. Or the tubing can be flattened to provide more surface area when it is folded into a given volume of space. The tubing may also have vanes attached to provide more surface area. The evaporator can also be an interconnected hollow core honeycomb such as the radiator of an automobile. These and many other evaporator designs are well-known in the art. In any event, the cool liquid passing through evaporator 4 absorbs heat from the air in contact with the exterior surface of the evaporator and, when enough heat energy, called the heat of vaporization, has been absorbed, converts back into a gas, which is at approximately the same temperature as the cool liquid entering the evaporator, the heat absorbed having been used in the vaporization process. When the device is being used as a dehumidifier, the operating parameter of metering device 3 is such that the temperature of the cool, low pressure liquid circulating through the evaporator 4 is below the dew point of the air in contact with the exterior surface of the evaporator. The dew point is the temperature at which water vapor in air will condense. Thus, as the cool liquid circulates through the evaporator, absorbs heat from the surrounding air through the surface of the evaporator and vaporizes, water vapor-containing air in contact with the evaporator is cooled to below its dew point. Water vapor in the air then condenses on the evaporator and flows out of the system. The cool gas returns to the compressor to begin another cycle. A receiver is sometimes placed in the system between the condenser and the metering device to store the warm, high pressure, refrigerant liquid until it is called for by the metering device.

When the purpose of the device shown in FIG. 1 is merely to cool and/or dry air, the water condensing on the evaporator is allowed to simply drain away. When the purpose is to collect potable water, a reservoir is placed beneath the evaporator. Care must be taken to assure that the water is obtained in potable condition and that it remains so after collection. This is accomplished by manufacturing the evaporator, the reservoir and any other parts of the device that come in contact with the moist air or the condensed water, from non-contaminating materials or to coat or; line potentially contaminating materials with the non-contaminating kind. Examples of such materials are stainless steel, glass and a broad range of polymeric materials such as PVC, Teflon® and the like. To ensure that collected water remains potable, such procedures as irradiating the water with ultraviolet light, bubbling ozone through it, adding iodine or other chemical anti-microbial agents, etc., are often used.

The device described above works reasonably well at ambient air temperatures above about 55° F. A problem arises, however, when the air temperature is below about 55° F. such as might be encountered in refrigeration units, fruit and vegetable produce drying rooms and meat storage lockers or when potable water is needed and the ambient temperature is less than about 55° F., such as at night or in winter. The problem is that, as water vapor, which is at about 55° F. or below, is condensed on the evaporator surface of the device in FIG. 1, it is rapidly cooled further because the evaporator surface is usually at a temperature substantially below 32° F. due to the thermodynamic characteristics of commonly used refrigerants and the normal operating modes of such devices. At 32° F. or below, the condensate freezes, forming ice on the evaporator. At ambient air temperatures below about 55° F., air that is in contact with the water on the surface of the evaporator cannot supply sufficient additional heat to counteract this freezing condition. As a result, ice builds up on the evaporator surface and acts as an insulator, isolating the evaporator surface from the moisture-laden air and thereby interfering with the operation of the device. When this occurs, the usual remedy is to turn off the compressor, shutting down the device, until the ice melts. The result is that the device of FIG. 1 is extremely inefficient at ambient air temperatures below about 55° F.

One approach that is employed to avoid evaporator icing is to simply run the device at higher refrigerant temperatures. This, however, limits the cooling capability of the device. Furthermore, if the goal is to remove water from the ambient air, it is preferred that the device be run as cold as possible so that the air is cooled to as close to the freezing point of water as possible since the colder the air, the less water it can retain. Running the device at a higher refrigerant temperature is thus inefficient since it leaves water in the air.

An approach employed to reduce inefficiency due to down time is to use multiple devices and to alternate use so that when the evaporator of one device has iced up, it can be shut down and another device started up. This, however, is an expensive, not to mention space-consuming, resolution.

What is needed is a device and method that performs a refrigeration cycle, in particular at temperatures below about 55° F. without evaporator icing. The present invention provides such a device.

SUMMARY OF THE INVENTION

Thus, in one aspect, this invention is related to a device that permits the operation of a refrigeration cycle while avoiding evaporator icing. The device comprises a compressor comprising an inlet and an outlet; a condenser, comprising an inlet and an outlet, wherein the condenser inlet is operatively coupled to the outlet of the compressor; a metering means, comprising an inlet and an outlet, wherein the inlet of the metering means is operatively coupled to the outlet of the condenser; an evaporator, comprising an inlet, an outlet and an evaporative surface, wherein the evaporator inlet is operatively coupled to the outlet of the metering means and the outlet of the evaporator is operatively coupled to the inlet of the compressor; a hot gas bypass means, comprising an inlet, an outlet, an open position and a closed position, wherein the hot gas bypass means inlet is operatively coupled to the outlet of the compressor and the hot gas bypass means outlet is operatively coupled to the inlet of the evaporator or to an inlet of a manifold, wherein:

the manifold comprises an inlet and a plurality of outlets, each outlet being operatively coupled to a different one of a plurality of inlets at different locations on the evaporative surface;

the hot gas bypass means also being operatively coupled to a controller; one or more means for detecting the initiation of ice formation on the evaporative surface, each means being operatively coupled to the evaporative surface wherein if there is more that one, each is operatively coupled to a different location on the evaporative surface, and to the controller; a controller operatively coupled to each means for detecting the formation of ice on the evaporative surface and to the hot gas by-pass means; and, a refrigerant that circulates from the compressor to the condenser to the metering means to the evaporator and back to the compressor in a refrigeration cycle.

In an aspect of this invention, the means for detecting the formation of ice on the evaporative surface comprise(s) one or more lasers.

In an aspect of this invention, the means for detecting the formation of ice on the evaporative surface comprise(s) one or more frost detectors.

In an aspect of this invention, the means for detecting the formation of ice on the evaporative surface comprise(s) one or more first temperature sensing means coupled to one or more work-load temperature sensitive sub-assembly(ies) of the device.

An aspect of this invention is any of the above devices which further comprises one or more second temperature sensing means coupled to the evaporative surface, wherein if there is more than one, each is coupled to a different location on the evaporative surface, and to the controller.

An aspect of this invention is the above device in which the means for detecting the formation of ice on the evaporative surface comprises one or more third temperature sensing means coupled to the evaporative surface wherein, if there is more than one, each is coupled to a different location on the evaporative surface.

The metering means comprises a thermostatic expansion valve in any of the above devices.

In the device comprising the third temperature-sensing means, the thermostatic expansion valve further comprises a temperature-sensing assembly in another aspect of this invention.

In an aspect of this invention, the temperature-sensing assembly comprises a double-walled container comprising an inner member and an outer member; a first space disposed between the inner member and the outer member; a second inner space circumscribed by the inner member; an inlet disposed proximate to, in and through a first end of the outer member, the inlet being operatively coupled to the outlet of the evaporator; an outlet disposed proximate to, in and through a second end opposite the first end of the outer member, the outlet being operatively coupled to the inlet of the compressor; a baffle disposed in the first space and extending from proximate to the first end of the outer member to proximate to the second end of the outer member; a temperature sensing bulb disposed in the inner space, the temperature sensing bulb being operatively coupled to the thermostatic expansion valve; and, a thermal compound also disposed in the inner space, the thermal compound being in contact with the inner member and the temperature-sensing bulb.

In any of the above devices, the hot gas by-pass means comprises a valve in an aspect of this invention.

The valve comprises a solenoid in an aspect of this invention.

An aspect of this invention is that, in any one of the above devices, each temperature-sensing means independently comprises a thermocouple or a thermistor.

The controller comprises a microprocessor in any of the above devices in an aspect of this invention.

An aspect of this invention is a method for performing a refrigeration cycle without ice build-up on the evaporative surface, comprising providing a compressor comprising an inlet and an outlet; providing a condenser, comprising an inlet and an outlet, wherein the condenser inlet is operatively coupled to the outlet of the compressor; providing a metering means, comprising an inlet and an outlet, wherein the inlet of the metering means is operatively coupled to the outlet of the condenser; providing an evaporator, comprising an inlet, an outlet and an evaporative surface, wherein the evaporator inlet is operatively coupled to the outlet of the metering means and the outlet of the evaporator is operatively coupled to the inlet of the compressor; providing a hot gas bypass means, comprising an inlet, an outlet, an open position and a closed position, wherein the hot gas bypass means inlet is operatively coupled to the outlet of the compressor and the hot gas bypass means outlet is operatively coupled to the inlet of the evaporator or to an inlet of a manifold, wherein:

the manifold comprises an inlet and a plurality of outlets, each outlet being operatively coupled to a different one of a plurality of inlets at different locations on the evaporative surface;

the hot gas bypass means also being operatively coupled to a controller; providing one or more means for detecting ice formation on the evaporative surface, each such means being operatively coupled to the evaporative surface wherein, if there is more than one means, each is coupled to a different location on the evaporative surface, and to the controller;

providing one or more temperature sensing means coupled to the evaporative surface and operatively coupled to the controller; providing a controller operatively coupled to each means for detecting the formation of ice on the evaporative surface, to each temperature sensing means and to the hot gas by-pass means; and, providing a refrigerant that circulates from the compressor to the condenser to the metering means to the evaporator and back to the compressor in a refrigeration cycle; wherein:

when the means for detecting ice formation on the evaporative surface detect(s) such ice formation, a signal is sent to the controller which in turn sends an open signal to the hot gas bypass means, the hot gas bypass means remaining open until the controller receives a signal from the temperature sensing means that is above a pre-set value, at which time the controller sends a close signal to the hot gas bypass means.

In the above method, the means for detecting the formation of ice on the evaporative surface comprise(s) one or more lasers in an aspect of this invention.

In the above method the means for detecting the formation of ice on the evaporative surface comprise(s) one or more frost detectors in another aspect of this invention.

In the above method, the means for detecting the formation of ice on the evaporative surface comprise(s) one or more first temperature sensing means coupled to one or more work-load temperature sensitive sub-assembly(ies) of the device in a further aspect of this invention.

In the above method, each temperature sensing means comprises a thermocouple or a thermistor in an aspect of this invention.

In the above method the metering means comprises a thermostatic expansion valve in an aspect of this invention.

In the above method, the hot gas by-pass means comprises a valve in an aspect of this invention.

In the above method, the valve comprises a solenoid in an aspect of this invention.

In the above methods, the controller comprises a microprocessor in an aspect of this invention.

An aspect of this invention is a method for performing a refrigeration cycle without ice build-up on the evaporative surface, comprising providing a compressor comprising an inlet and an outlet; providing a condenser, comprising an inlet and an outlet, wherein the condenser inlet is operatively coupled to the outlet of the compressor; providing a metering means, comprising an inlet and an outlet, wherein the inlet of the metering means is operatively coupled to the outlet of the condenser; providing an evaporator, comprising an inlet, an outlet and an evaporative surface, wherein the evaporator inlet is operatively coupled to the outlet of the metering means and the outlet of the evaporator is operatively coupled to the inlet of the compressor; providing a hot gas bypass means, comprising an inlet, an outlet, an open position and a closed position, wherein the hot gas bypass means inlet is operatively coupled to the outlet of the compressor and the hot gas bypass means outlet is operatively coupled to the inlet of the evaporator or to an inlet of a manifold, wherein:

the manifold comprises an inlet and a plurality of outlets, each outlet being operatively coupled to a different one of a plurality of inlets at different locations on the evaporative surface;

the hot gas bypass means also being operatively coupled to a controller; providing one or more temperature sensing means coupled to the evaporative surface, wherein if there is more than one, each is coupled to a different location on the evaporative surface; providing a controller operatively coupled to each temperature sensing means and to the controller; wherein:

each temperature-sensing means measures a temperature at its location on the evaporative surface and sends a signal corresponding to that temperature to the controller wherein, if the signal is at or below a pre-selected first set point temperature, the controller sends an open signal to the hot gas bypass means, the hot gas bypass means remaining open until the controller receives a signal from the temperature-sensing means than is above a pre-selected second set point temperature, at which time the controller sends a close signal to the hot gas bypass means.

In the above method, the metering means comprises a thermostatic expansion valve in an aspect of this invention.

In the above method, the thermostatic expansion valve further comprises a temperature-sensing assembly.

The temperature-sensing assembly comprises a double-walled container comprising an inner member and an outer member; a first space disposed between the inner member and the outer member; a second inner space circumscribed by the inner member; an inlet disposed proximate to, in and through a first end of the outer member, the inlet being operatively coupled to the outlet of the evaporator; an outlet disposed proximate to, in and through a second end opposite the first end of the outer member, the outlet being operatively coupled to the inlet of the compressor; a baffle disposed in the first space and extending from proximate to the first end of the outer member to proximate to the second end of the outer member; a temperature sensing bulb disposed in the inner space, the temperature sensing bulb being operatively coupled to the thermostatic expansion valve; and, a thermal compound also disposed in the inner space, the thermal compound being in contact with the inner member and the temperature-sensing bulb, in another aspect of this invention.

In the above methods, the hot gas by-pass means comprises a valve in an aspect of this invention.

In the above method the valve comprises a solenoid in an aspect of this invention.

In the above methods, each temperature-sensing means independently comprises a thermocouple or a thermistor in an aspect of this invention.

In the above methods, the controller comprises a microprocessor in an aspect of this invention.

DETAILED DESCRIPTION OF THE INVENTION

BRIEF DESCRIPTION OF THE FIGURES

Figures are provided solely to aid the reader in understanding the invention. They are not intended and are not to be construed as limiting the scope of this invention in any manner whatsoever.

FIG. 3 is a schematic representation of a refrigeration cycle device of this invention using a TXV metering means and a hot gas bypass.

FIG. 4 is a schematic representation of a temperature-sensing assembly of this invention.

DEFINITIONS

Figure 1:
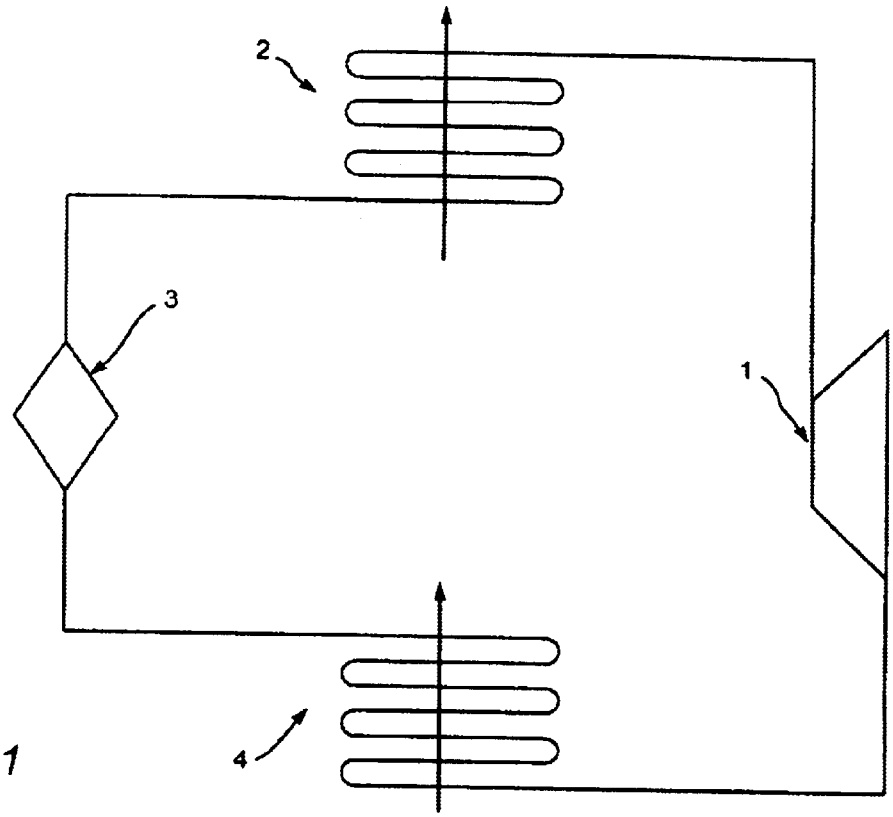
FIG. 1 is a schematic representation of a prior art refrigeration cycle device.

As used herein, a "refrigerant" or a "refrigerant gas" relates to a fluid that, in its liquid form has a boiling point below that of water. Examples, without limitation, of refrigerants are ammonia, sulfur dioxide and Freon®.

As used herein, a "compressor" refers to any device that is capable of pressurizing a fluid, including liquids and gases. In the present invention, the compressor is capable in particular of pressurizing a gas. Many such devices are well-known in the art and any such device is within the scope of this invention.

As used herein, a "condenser" refers to any device that is capable of receiving compressed or pressurized gas from a compressor, releasing heat energy from the compressed gas and converting it to a liquid while essentially maintaining the pressure established by the compressor. Such devices are likewise well-known in the art and any such device is within the scope of this invention.

As used herein, a "metering means" or "metering device" both refer to any device that is capable of receiving a liquid at a first pressure at its inlet and expelling that liquid at a second, reduced pressure at its outlet. Such devices include, without limitation, a simple orifice, an orifices containing a floating piston, a flow restrictor, a capillary tube and a thermostatic expansion valve (TXV). These and other such devices are well-known in the art and all are within the scope of this invention.

As used herein, an "evaporator" or an "evaporator assembly" both refer equally to any device, which has a large exterior surface area, called herein, the "evaporative surface," over which air containing water vapor may circulate with the result that, when the temperature of a liquid within the evaporator is below the dew point of the air flowing over it, water vapor in the air will condense on the exterior surface of the evaporator and gravitationally flow off of it while, at the same time, the liquid in the evaporator vaporized to a gas.

As used herein, "hot gas bypass," "hot gas bypass means" or "hot gas bypass device" all refer to a device which is capable of controllably delivering a hot fluid from a first location to a second location where there is a cool fluid in such a manner that the two fluids mix, while bypassing other devices disposed in a different path that also connects the first location with the second location. A "fluid" may refer to a gas or a liquid. With regard to a hot gas bypass, an "open signal" refers to a signal that, when received by the hot gas bypass, causes the hot gas bypass to open and allow the hot fluid to flow and mix with the cool fluid. Conversely, a "close signal" is a signal that, when received by the hot gas bypass, causes the hot gas bypass to close thereby discontinuing the mixing of flow of hot gas with the cool liquid.

By "controllably delivering" is meant that the device is capable of opening and closing such that only that amount of hot fluid is delivered to and mixed with cool fluid as is required to maintain a selected temperature in the fluid resulting from the mixing of the hot and the cool fluids.

As used herein, a "refrigeration cycle" refers to the well-known thermodynamic cycle of gas compression to a hot, high pressure gas, condensation of the hot, high pressure gas to a warm, high pressure gas with concomitant release of heat energy to the external surroundings, metering of the warm, high pressure gas through a device permitting expansion of the liquid to afford a cool, low-pressure liquid, evaporation of the cool, low pressure liquid to a cool, low pressure gas with concomitant absorption of heat energy from the external surroundings and re-compression of the cool, low pressure gas to begin the cycle again. In one sense, the refrigeration cycle is considered to be a cooling means. However, if air in contact with the outside of the evaporator contains water vapor and the temperature of the cool liquid in the evaporator is below the dew point of the air, then water will condense on the outside of the evaporator resulting in its removal from the air. Thus, the refrigeration cycle may be considered a water-removal means as well as a cooling means. With regard to the terms "hot," "warm" and "cool," when referring to the refrigerant liquid/gas used in the device herein, it is to be recognized that these terms are being used strictly in their comparative sense, that is, "hot" is a higher temperature than "warm," which is a higher temperature than "cool." It is unnecessary to the understanding or operation of the device and method of this invention to speak in terms of absolute temperatures or temperature ranges, except where expressly set forth, because these will depend on the refrigerant used, the degree of pressurization of the refrigerant in the compressor, the amount of heat that must be removed from the hot, high pressure gas in the condenser to obtain a liquid, etc. and each of these is readily determinable by those skilled in the art using standard thermodynamic principles.

As used herein, a "temperature sensing means" refers to a device that is capable of measuring temperature at a specific location and includes, without limitation, a thermometer, a thermocouple, a thermister and the like.

As used herein, a "controller" refers to a device that is capable of causing an event based on a received signal. For example, in the present invention, a controller is a device that, upon receiving the appropriate signal from a temperature sensing means is capable of causing the hot gas bypass to open or close and thereby permit or prohibit the mixing of hot gas and cool liquid. A controller may comprise mechanical, electrical or optical components of combinations thereof. In a presently preferred embodiment of this invention, a controller comprises a microprocessor.

A "thermostatic expansion valve" or "TXV" refers to the well-known in the refrigeration art device commonly used in refrigeration systems for causing the expansion of the warm, high pressure liquid coming from the condenser of such a system to a cool, low pressure liquid.

As used herein, a "temperature-sensing gas bulb" refers to the well-known in the refrigeration art device that controls the amount of high pressure warm liquid that is expanded in a TXV at a given time, As used herein, a "temperature-sensing assembly" refers to a temperature-sensing gas bulb in combination with a double-walled container and a thermal compound as described elsewhere herein.

A "thermal compound" refers to a material that is thermoconductive and can transfer temperatures detected in one region of a volume of the material quickly and accurately to another region of a volume of the material.

As used herein, a "double walled container" refers to a container that has an inner and an outer wall and a space between them. An example, without limitation, of a double-walled container is a common Thermos®. In fact, a Thermos®, modified in a manner that will be clear to those skilled in the art based on the disclosures herein, would comprise a "double-walled container" of this invention.

As used herein, a space "circumscribed" by a member refers simply to a volume within a container such as, without limitation, the volume in a can, a cup, a Thermose or a bottle wherein the volume is uniquely determined and confined by the inner surface of the can, cup, Thermos® or bottle.

As used herein, a "baffle" refers to a partial obstruction placed in the flow path of a fluid in a conduit such that, to continue flowing, the fluid must negotiate around the partial obstruction such that the effective length of the path of the fluid through the baffled area is greater than it would have been in the absence of the baffle and, thus, the residence time of the fluid in that part of the conduit is longer.

As used herein, a "hot gas bypass valve" refers to any manner of valve that can be placed in a conduit in such a manner that opening and closing the valve permits or prohibits the flow of a fluid through the conduit. Examples, without limitation, of hot gas bypass valves would be needle valves, stop-cock valves and internal piston solenoid valves and zero-differential solenoid valves.

A "solenoid" refers to the well-known control device wherein electromagnetic force is used to move a plunger, the movement of which can cause another device or another portion of a device containing a solenoid to start or stop, open or shut, etc.

Ozone is a triatomic version of oxygen; i.e., $O_3$.

An "ozone generator" refers to a device that produces ozone from oxygen. Common types of ozone generators are a corona discharge generator, a cylindrical dielectric generator, an electrostatic generator and a Siemens-type generator. Any of these ozone generators may be used with the device of this invention. However, in a presently preferred embodiment of this invention, an electrostatic ozone generator is used.

"Fritted glass" refers to beads or fibers of glass that have been fused together at a temperature that forms a relatively strong glass object such as, without limitation, a disk, a solid glass tube, a mat, etc., but that is sufficiently porous to permit gases to disperse through in bubble sizes dependent on the size of the pores. As used herein "fritted glass dispersion device" is a device which is placed in a water collection reservoir placed under an evaporator and which is connected to an ozone generator such that ozone from the generator flows through and is dispersed in small bubbles into water in the collection reservoir.

A "thermocouple" is a device consisting of two dissimilar metals joined such that a potential difference is generated between the points of contact is a measure of the temperature difference between the points.

The "dew point" is the temperature to which air must be cooled at constant pressure and water vapor content in order to reach saturation. A state of saturation exists air is holding the maximum amount of water vapor possible at a given temperature and pressure without the water vapor condensing to liquid water. At temperatures below the dew point, water vapor in the air precipitates as liquid water.

A "microprocessor" refers to an integrated circuit containing the arithmetic, logic and control circuitry required to interpret and execute instructions from a computer program.

As used herein, the term "about" refers to ±5% of any value given.

Discussion

FIG. 1, which schematically depicts a prior art standard refrigeration cycle device, is described in the Background section.

The present invention relates to a device that operates in a refrigeration cycle while avoiding ice formation on its evaporative surface. While the device will operate without icing at virtually any temperature, it is particularly useful at low ambient temperatures; i.e., temperatures below about 55° F. and even at temperatures at or below freezing (below 32° F.). It is at the lower ambient air temperatures that icing is particularly problematic and the device herein is of the greatest utility. By "ambient air temperature" is meant the temperature of atmospheric air external to and in the environs wherein the device is located.

A presently preferred embodiment of this invention is a device for avoiding evaporator icing at ambient air temperatures from any temperature up to about 55° F.

To accomplish the above, a device of this invention comprises a hot gas bypass that permits the output of a compressor, i.e., hot, high pressure gas, to be mixed with the output of a metering means, i.e., cool, low pressure liquid, in a controlled manner, at a location proximate to the output of the metering means. Examples of useful metering means are a simple orifice, an orifice with a floating piston, a capillary tube or a thermostatic expansion valve (TXV). The hot gas bypass is in communication with a controller. The controller is also in communication with one or more temperature sensors, which are placed proximate to the inlet of the evaporator or at various locations on the evaporative surface. The temperature sensors measure the temperature of the low pressure liquid entering the evaporator, if the sensor is located proximate to the inlet to the evaporator, or the temperature of the evaporative surface wherever on the surface the sensor is placed, and provides a signal corresponding to that temperature to the controller. The controller comprises a low temperature set point and a high temperature set point. When the temperature sensor sends a temperature signal to the controller that is at or below the low temperature set point, the controller causes the hot gas bypass to open, permitting hot gas from the outlet of the compressor to mix with the cool liquid entering the evaporator, warming it. The warmer liquid requires less heat energy to vaporize and does not absorb as much heat from the air flowing over the evaporative surface or from the water condensing thereon. Thus, water on the evaporative surface is not cooled to the freezing point and no ice forms. When the temperature sensor sends a signal to the controller that is at or above the high temperature set point, the controller causes the hot gas bypass to close. Thus, the hot gas bypass can provide precise control, within fractions of a degree F, of the temperature of the liquid flowing through the evaporator and, therefore, of the evaporator surface and of water condensing on that surface. The temperature of the water on the evaporative surface can be maintained at a temperature barely above freezing without ice formation which results in maximum efficiency both in terms of extracting as much water as possible from the ambient air in contact with the evaporative surface and avoidance of downtime due to evaporator freezing.

The hot gas bypass of this invention may comprise a unit with a single inlet and a single outlet, in which case the outlet is usually operatively coupled to the outlet of the metering means (or the inlet of the evaporator, which, practically speaking is the same as the outlet of the metering means since, as can be seen in FIG. 1, the outlet of the metering means is coupled to the inlet of the evaporator). However, it is within the scope of this invention that the hot gas bypass comprises a manifold having one inlet coupled to the outlet of the compressor and a plurality of outlets coupled to inlets at various points on the evaporative surface. Such an arrangement would generally and most advantageously be used in conjunction with a plurality of ice formation sensors, likewise located at various points on the evaporative surface. The inlets from the hot gas bypass manifold could be located at any desired distance upstream, i.e., in the direction counter to the flow of refrigerant in the system, from the sensors. When a sensor senses a local formation of ice, it would send a signal to the controller which in turn would send a signal to the manifold to open, without limitation, a solenoid operated valve upstream from that sensor. In this manner, precise, local control of the temperature of the evaporative surface would be possible. This latter device and procedure would be particularly useful when very large evaporative surfaces are being used.

The above described device of this invention will accomplish the purpose of this invention, i.e., operate in a refrigeration cycle while avoiding evaporator icing, at virtually any temperature, however, it is particularly effective under extreme conditions, i.e., ambient air temperatures below 55° F. even below 32° F. It would also be particularly useful during very long periods of continuous operation. At temperatures above about 55° F.; however, a device of this invention may further comprise, as the metering means, a thermal expansion valve (TXV) that is controlled by a temperature-sensing bulb assembly. A TXV can also control the temperature of liquid entering an evaporator but does so by controlling the amount of liquid that reaches the evaporator at any given time rather than by injecting hot gas into the liquid stream entering the evaporator. Thus, under less extreme conditions, that is, at temperatures above about 55° F. a TXV can reduce some of the work-load on the hot gas bypass by providing an additional degree of control of the temperature of liquid entering the evaporator. TXVs are well-known in the art as are the temperature sensing bulbs that control them. However, the temperature-sensing assembly described herein, which provides a degree of TXV control precision consummate with a device of this invention, i.e., that allows operation of the device without icing of the evaporative surface, is novel.

The temperature-sensing assembly comprises a thermal well in which a standard temperature-sensing bulb is placed, the thermal well being constructed so as to rapidly transmit small changes in the temperature of the gas exiting the evaporator outlet to the temperature-sensing bulb which can then precisely control the operation of the TXV. To accomplish this, the thermal well has a baffled annular space through which the liquid refrigerant passes before entering the evaporator. The baffle increases the residence time in the annular space to ensure that temperature changes in the liquid refrigerant are transmitted to the wall of the thermal well. The space between the temperature-sensing bulb and the wall of the thermal well is filled with a highly thermo-conductive material that efficiently and rapidly transmits changes in refrigerant liquid temperature from the wall of the thermal well to the temperature-sensing bulb.

A device of this invention may also comprise one or more frost sensors at various points on the exterior surface of the evaporator as an added icing deterrent during extreme temperature or prolonged continuous operation conditions. Frost detectors, which are capable of detecting the initial formation of ice on a surface, are well-known in the art and would be used without modification with a device of this invention. However, rather than operate in the normal fashion of conventional frost detectors and simply turn off the compressor if frost is detected, in the present invention, the frost detectors are in communication with the controller. When the controller receives a signal from the frost sensor that ice is beginning to form in the vicinity of that sensor, it sends a signal to open the hot gas bypass. The hot gas bypass might be programmed to remain open for a brief predetermined period of time during which a small charge of hot gas is injected into the liquid entering the evaporator. These bursts of hot gas would continue until the frost sensor stops sending a frost signal. In the alternative, once the open signal has been sent to the hot gas bypass, the hot gas bypass remains open until the frost detector stops sending a signal to the controller, indicating that ice is no longer being detected, at which time the controller sends a close signal to the hot gas bypass.

Another device for the detection of ice formation would be one or more lasers. The laser would monitor the surface of the evaporator and alert the controller when ice, virtually at the mono-molecular thickness level, was beginning to form on the evaporator. This could be accomplished, without limitation, by using the laser to detect minute changes in the distance between the laser and the evaporative surface, i.e., by thickness measurement. It could also be accomplished by detecting changes in the wavelength of light being emitted by the laser due to its passing through a forming layer of ice. Other ways to use a laser will become apparent to those skilled in the art based on the disclosures herein; all such approaches are within the scope of this invention.

An alternative or, if desired, concurrent means for preventing ice formation on the evaporator, which would be particularly useful when the use to which the device herein is being put is the maintenance of the air temperature in a room or chamber at below the freezing point of water; i.e., lower than 32° F. would be to employ a temperature sensor that detects the temperature of a surface of a work-load temperature sensitive sub-assembly of the device. By "sub-assembly" is meant, without limitation, any discrete portion of the device such as the condenser, the evaporator, the compressor, the metering means, etc. By "work-load temperature sensitive" is meant that, as the amount of work that the sub-assembly must do to maintain the temperature in the room or chamber at the selected sub-freezing temperature increases, the temperature of a surface, usually the outer surface, of the sub-assembly rises. The sensor would be attached to surface of the sub-assembly and, during the initial operation of the device, would continuously detect its temperature and transmit the temperature to the controller. The controller would then recognize that temperature, which, since it would be generated during the early stage of operation of the device during which ice would not have time to form, as the "normal operating temperature" of the subassembly. Since the normal operating temperature would not likely be absolutely stable even during normal operation, the controller could be programmed to establish a temperature range based on the transmitted temperature, which would then be the "normal operating temperature range." During operation of the device, the sensor would continuously detect and transmit to the controller the temperature of the surface of the sub-assembly. When the controller receives a temperature signal that is outside, usually above, the normal operating temperature range, the controller would cause the hot gas bypass to open briefly which would result in a burst of hot gas to mix with the cool liquid entering the evaporator warming it and thereby melting any ice that was beginning to form on the evaporative surface. In the alternative, the controller could cause the hot gas bypass to open and remain open until the controller receives a signal that is within the normal operating temperature range at which time the controller would send a close signal to the hot gas bypass. An example, without limitation, of a work-load temperature sensitive sub-assembly of the device herein would be the compressor. As the compressor works harder to maintain a desired room or chamber temperature, the case of the compressor will warm slightly. This increase in case temperature would be detected by the sensor and transmitted to the controller which would interpret the signal as an indication that that the device was working harder due to the formation of ice on the evaporative surface. The controller would then send an open signal to the hot gas bypass, causing a release of hot gas from the hot gas bypass. Another subassembly that could be used to detect initial ice formation would be the motor of the fan than circulates air over the evaporative surface. As ice begins to form on the evaporative surface, air being blown over and in contact with the surface would come in contact with the ice, which is at 32° F., instead and not the surface, which would be at a at a sub-freezing temperature. The fan would then have to stay on longer and work harder to try to get the temperature of the air to the desired lower temperature and, as a result, the temperature of the fan motor will rise. When the controller received a temperature reading from a sensor attached to the surface of the motor that is above the "normal operating temperature" of the motor, the controller again causes the hot gas by-pass to open. Other sub-assemblies that are work-load temperature sensitive will be apparent to those skilled in the art. Any of these can be used in the above manner to control the formation of ice on the evaporative surface; all such sub-assemblies are within the scope of this invention.

The device of this invention may also comprise a plurality of evaporators. The evaporators may be connected in parallel off of a manifold, which in turn may be connected to the outlet of the metering means, the outlet of the condenser or the outlet of the compressor. In each of these cases, the requisite additional elements of the device would be connected to the manifold. That is, for example, if the manifold is connected to the outlet of the compressor, then a condenser and a metering means would be included between the manifold and each evaporator. Each evaporator can then be connected to its own hot gas bypass, its own temperature sensor and controller and, optionally, its own TXV and temperature-sensing assembly. Or a plurality of evaporators may be connected to a manifold which, in turn, is connected to a single hot gas bypass/temperature sensor/controller/TXV/temperature-sensing assembly.

Figure 2:
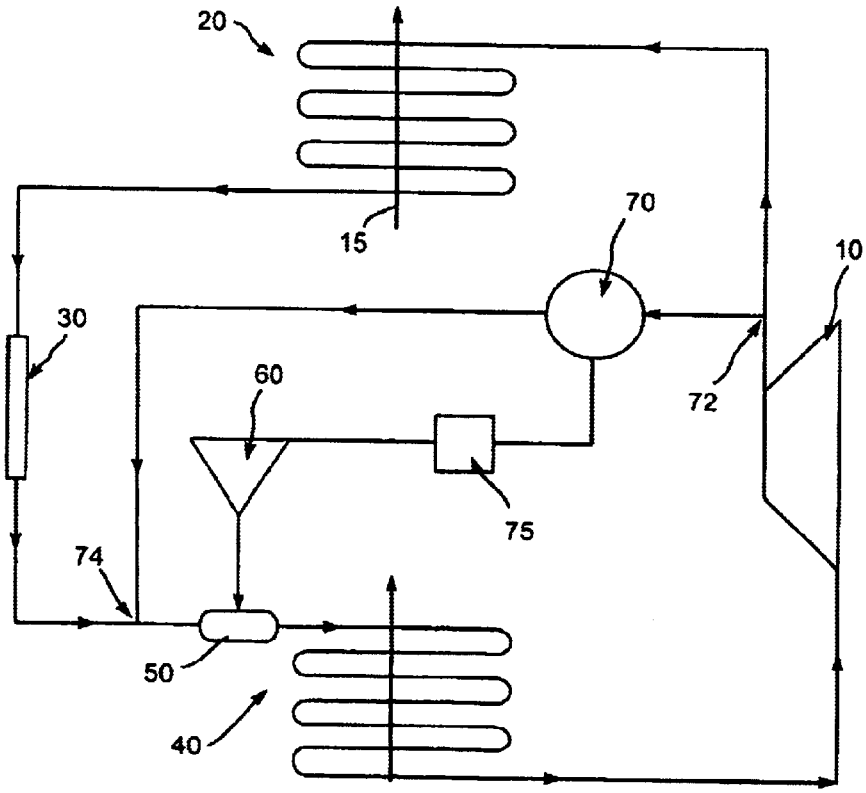
FIG. 2 is a schematic representation of a refrigeration cycle device of this invention using a capillary metering means and a hot gas bypass.

FIG. 2 schematically depicts a device of this invention. The device comprises a compressor 10 that compresses a refrigerant gas, heating it in the process, and delivers the compressed hot refrigerant gas to condenser 20. Condenser 20 receives the hot refrigerant gas and condenses it to a warm liquid refrigerant meanwhile transferring the heat of condensation to air flowing over and in contact with the surface of condenser 20, for example, in the direction of arrow 15. A capillary tube 30 receives the hot liquid refrigerant and expands the same to a liquid of reduced temperature and pressure. At this point, some of the reduced temperature liquid may already be converted to a gas so that, in fact, the fluid at the outlet of the capillary tube 30 is a mixture of liquid and gas. However, for the purposes of the refrigeration cycle that the liquid/gas is undergoing, it is the liquid that is important. The cool liquid refrigerant next passes into and through evaporator 40 wherein it exchanges thermal energy with the inner surface of evaporator 40, the outer surface of which is in contact with external circulating air. That is, the cool refrigerant liquid absorbs heat from the circulating air through the surface of evaporator 40. As the result of the absorption of heat, the cool refrigerant liquid vaporized to a cool refrigerant gas. The temperature of the cool refrigerant gas is essentially the same as that of the liquid from which it was generated, the energy absorbed being the heat of vaporization. The cool gas then travels to compressor 10 and the cycle begins anew. The circulation of the refrigerant from compressor 10 to condenser 20 to capillary 30 to evaporator 40 and back to compressor 10 is called the refrigeration cycle. The refrigeration cycle, however, may also be thought of as a water removal cycle if the air circulating over evaporator 40 contains water vapor and if the temperature of the air is reduced to below its dew point so that water condenses on the outer surface of the evaporator. In one embodiment of the present invention, the cool refrigerant liquid flowing through evaporator 40 is in fact maintained at a temperature that is below the dew point of external ambient air in contact with the evaporative surface so that, if the air contains water vapor, that water vapor will condense on the surface. The water then will gravity-flow off the evaporative surface and either be discarded, if air drying is the use to which the device is being put, or into a container if production of potable water is the purpose of the device.

In order for the device of FIG. 2 to operate without ice build-up on the evaporative surface, the device includes a hot gas bypass assembly. That is,. thermocouple 50, which is coupled to the outer surface of the line at or near the inlet 42 of evaporator 40, derives the temperature of the cool liquid entering-evaporator 40 from the temperature of the line and sends a signal corresponding to that temperature to microprocessor 60. Microprocessor 60 is programmed with a first and a second set point temperature. The first set point temperature is a low set point temperature and the second set point temperature is a high set point temperature.: The set point temperatures are calculated as the temperatures that will maintain the liquid entering evaporator 40 at a desired temperature, which, in a presently preferred embodiment hereof, is between 32.5° F. and 33° F. The actual value of the set point temperatures will vary based on the thermodynamic characteristics of the material used in the manufacture of the line and to the sensitivity of the thermocouple. For example, without limitation, if the line is made of copper, which is highly thermoconductive, the set point temperatures are set close to the desired liquid temperature. On the other hand, if the line is made of steel, which is less thermoconductive, the temperatures must be set so as to allow for the lag time in temperature change at the outer surface of the line compared to that of the liquid in the line. Determination of appropriate high and low temperature set points is essentially empirical but is well within the capability of those skilled in the art based on the disclosures herein.

When microprocessor 60 receives a temperature signal from thermocouple 50 that is at or below the low set point temperature, microprocessor 60 sends a signal to solenoid 75 which is then activated. When activated, solenoid 75 causes hot gas bypass valve 70 to open. When hot gas bypass valve 70 opens, hot gas from the outlet side 72 of compressor 10 is delivered to the inlet side 42 of evaporator 40 where it mixes with the cool liquid, possibly containing some cool gas, and warms the liquid. When the temperature signal received by microprocessor 60 is at or above the second, high temperature set point, the microprocessor stops sending a signal to solenoid 75, which then deactivates, allowing hot gas bypass valve 70 to close. In this manner, the temperature of the liquid entering evaporator 40 is precisely controlled.

Rather than a simple capillary tube, the metering means may also be a TXV as shown in FIG. 3. If so, the amount of hot liquid refrigerant being expanded by TXV 33 is controlled by temperature sensing bulb 35, which is situated in thermal well 38 (FIG. 4). In a presently preferred embodiment of this invention, the thermal well/temperature-sensing bulb is located at the outlet from the evaporator. However, the thermal well/temperature-sensing bulb may be located at other positions such as at the inlet of the evaporator also. Thermal well 38 is, for example, without limitation, a double-walled cylinder having walls 100 and 101 and space 110 between them. Space 110 contains a baffle or series of separate baffles 120 that run throughout space 110. Thermal well 38 also has an inlet 112 to space 110 and an outlet 113 from space 110. The temperature in thermal well 38 is derived from the temperature of the cool refrigerant liquid at the inlet to evaporator 40. This is accomplished by diverting the cool refrigerant liquid before it enters evaporator 40 into inlet 112 through space 110 wherein it is flows around baffle 120, which results in it being in contact with inner wall 101 for a sufficient period of time for inner wall to be cooled to the same temperature as the liquid, and then out through outlet 113 and into evaporator 40. In this manner also, the liquid is in contact with inner wall 101 for a sufficient time that the temperature of inner wall 101 will change to reflect changes in the temperature of the liquid. Temperature-sensing bulb 35 is surrounded by thermal compound 130, which is a substance that rapidly and efficiently conducts heat so that changes in temperature at inner wall 101 are rapidly and efficiently transmitted to temperature-sensing bulb 35. Examples of such substances are, for example and without limitation, phase change thermal compounds (PCTC) such as Chromerics T725, MPU 3/7 Aluminum Oxide or Arctic Silver. Temperature-sensing bulb 35 contains a gas such as, without limitation, a Type "C" gas, the pressure exerted by which is extremely temperature sensitive. Thus, as the temperature in thermal well 38 decreases due to a decrease in the temperature of the gas at the inlet to the evaporator 40, the pressure in sensing bulb 35 decreases. As the pressure decreases, a spring (not shown) in TXV 33, which has been compressed due to pressure being placed on it by the gas in sensing bulb 35, pushes against and closes a diaphragm (not shown) in TXV 33, which results in a restriction in the flow of refrigerant through TXV 33. TXVs, sensing bulbs and their operation are well known to those skilled in the art. The use, however, of baffled thermal well 38 and thermal compound 130 to obtain rapid transfer of small temperature changes from the cool refrigerant liquid to sensing bulb 35, is novel and is a part of this invention.

The TXV/temperature-sensing bulb/thermal well of this invention effectively prevents icing of evaporator 40 at ambient air temperatures above about 55° F. However, as air temperature goes below about 55° F. the TXV/temperature-sensing bulb/thermal well system is not capable of controlling the temperature of the liquid on the input side of the evaporator enough to stop icing of the evaporative surface. Thus, at temperatures below about 55° F. the hot gas bypass of this invention comes into play. Thermocouple 50, which is coupled to the outer surface of the line connecting TXV 33 with evaporator 40, derives the temperature of the cool liquid entering evaporator 40 from the temperature of the line and sends a signal corresponding to that temperature to microprocessor 60. Microprocessor 60 is programmed with a first and a second set point temperature. The first set point temperature is a low set point temperature and the second set point temperature is a high set point temperature. The set point temperatures are calculated as the temperatures that will maintain the liquid entering evaporator 40 at a desired temperature, just as they are when the metering means is a capillary, described above. Thus, in a presently preferred embodiment of this invention, it is desirable to maintain the temperature of the refrigerant liquid entering the evaporator at between 32.5° F. and 33° F. and the set point temperatures are set accordingly. However, if a device of this invention is to be used in a freezer where the goal is to cool ambient air to below 32.5° F., then the temperature of the refrigerant liquid must be substantially colder and the set point temperatures are set such as to maintain that colder temperature. Thus, the values of the set point temperatures will depend on the use to which the device is being put and the determination of those temperatures will be well within the capability of those skilled in the art based on the disclosures herein.

When microprocessor 60 receives a temperature signal from thermocouple 50 that is at or below the low set point temperature, microprocessor 60 sends a signal to solenoid 75 which is then activated. When activated, solenoid 75 causes hot gas bypass valve 70 to open. When hot gas bypass valve 70 opens, hot gas from the outlet side 72 of compressor 10 is delivered to the outlet side 74 of TXV 33 where it mixes with the cool liquid, possibly containing some cool gas, and warms the liquid. When the temperature signal received by microprocessor 60 is at or above the second, high temperature set point, the microprocessor stops sending a signal to solenoid 75, which then deactivates, allowing hot gas bypass valve 70 to close. In this manner, the temperature of the liquid entering evaporator 40 is precisely controlled.

Figure 5:
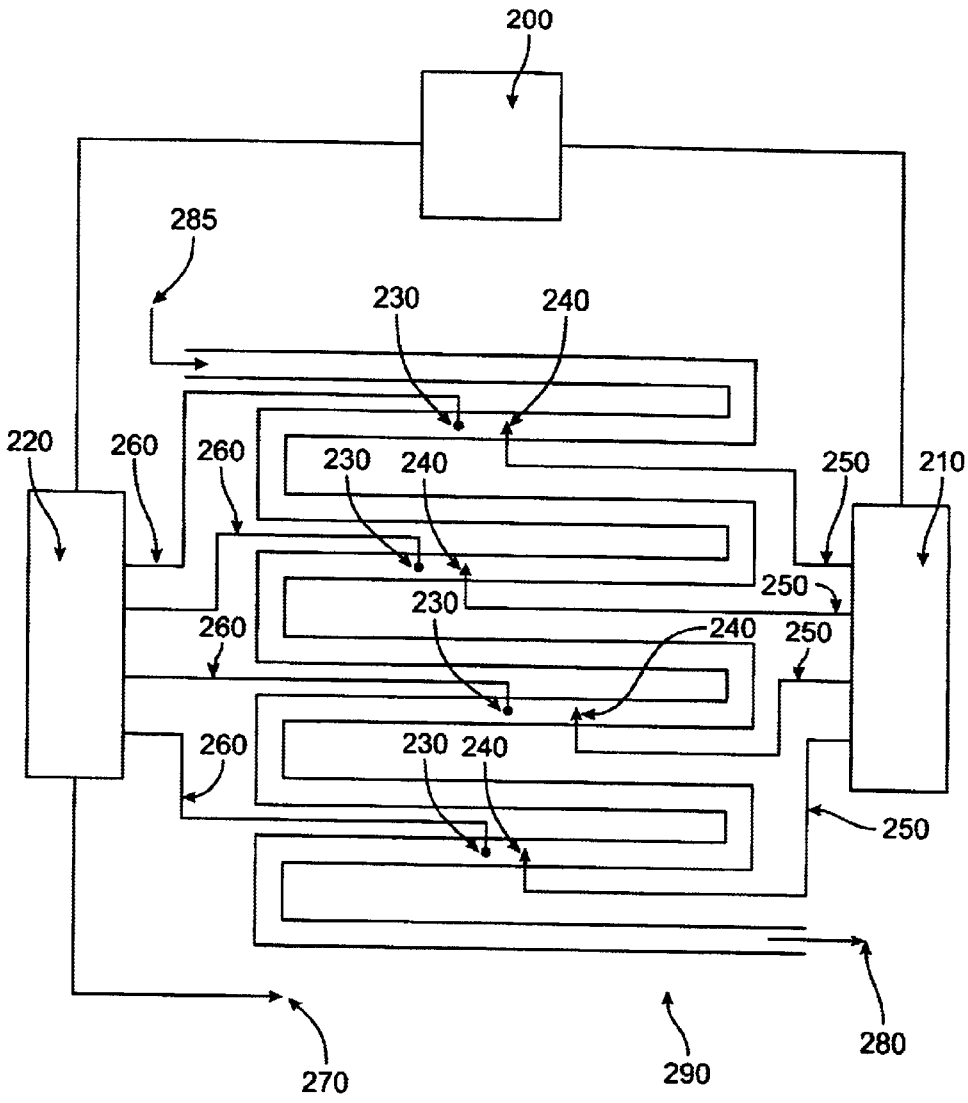
FIG. 5 is a schematic representation of a portion of a device of this invention, that portion being a plurality of ice formation detectors on the evaporative surface, a manifold hot gas bypass system and the controller that integrates the two to prevent the buildup of ice on the evaporative surface.

A device of this invention may comprise a hot gas bypass manifold and a plurality of ice formation sensors. This is shown in the schematic of FIG. 5. In FIG. 5, multiple ice formation sensors 240 monitor evaporative surface 290 for the formation of ice. Monitoring points 240 may comprise sensors coupled directly to the evaporative surface, such as in the case of temperature sensors or frost sensors, or they may monitor the surface in a remote fashion as in the case of a laser beam directed at the surface. In any event, the signal from the sensors may be collected at bus 210 through connection 250 or they may be sent directly to a controller 200. Connections 250 may, without limitation, be hard wired or they may comprise radio signal connections. They are depicted in FIG. 5 as wires for ease of understanding only. When controller 200 receives a signal from one or more of sensors 240, it sends a signal to hot gas bypass manifold 220. Manifold 220 has an inlet 270 that is connected to the outlet of a compressor (not shown). Thus, manifold 220 contains hot gas from the outlet of the compressor. When the manifold receives a signal from controller 200, the appropriate line or lines 260 is/are opened so that hot gas may enter evaporative surface 290 at one or more of inlets 230. The opening and closing of the lines is controlled by, without limitation, solenoid activated valves. Other means of controlling the opening and closing of the lines will become apparent to those skilled in the art based on the disclosures herein and are within the scope of this invention. Inlets 230 are located at an optional distance upstream, that is in direction counter to the flow of refrigerant through the system (i.e., refrigerant enters the evaporator at 285 and exists at 280) from ice formation sensors 240. Thus, hot gas will enter the evaporator at 230 and mix with the refrigerant liquid therein resulting in warming of the evaporative surface in the downstream direction. Lines 260 will remain open until controller 200 ceases to receive a signal from sensors 240 or, when the sensors are temperature sensors, until controller 200 receives a signal from sensors indicating that a selected second set point temperature (the first set point temperature being a low temperature indicating icing) has been reached. At such time, controller 200 sends a signal to hot gas bypass manifold 220 to close lines 260 so that no more hot gas will pass to inlets 230 to mix with the refrigerant. In this manner, very precise control of the formation of ice on the evaporative surface can be achieved.

If desired, a receiver (not shown) may be included in the line connecting condenser 20 and TXV 30. The received acts as a reservoir, holding the warm, high pressure refrigerant liquid until it is needed by the metering device.

When a device of the present invention is used to produce potable water, a container is placed underneath the evaporator to collect water flowing off it. The container is either made of a non-contaminating material such as, without limitation, Teflon®, PVC, nylon and other synthetic polymers, stainless steel, glass and the like or is lined or coated with such a material. A presently preferred material for coating all elements that come in contact with water is an enamel material known as FDA Gray. The container may simply be placed under the evaporator or it may be detachably fitted to the lower portion of the evaporator to give a compact portable unit. In addition, the container may be fitted with a fritted glass gas dispersing element which is connected to an electrostatic ozone generator so that ozone can be bubbled through the collected water to inhibit the growth of microorganisms and maintain the purity of the water. A device of this invention used for the collection of potable water also may include one or more filters such as a carbon block, a limestone of a sediment filter to further assure the potability of the collected water.

CONCLUSION

Thus, it will be appreciated that the present invention provides a device and method for preventing icing of the evaporative surface of an evaporator during operation of a refrigeration cycle. Although certain embodiments and examples have been used to describe the present invention, it will be apparent to those skilled in the art based on the disclosures herein that changes in the embodiments and examples shown may be made without departing from the scope of this invention.

Other embodiments are within the following claims.

What is claimed:

1. A device, comprising:

a compressor comprising an inlet and an outlet;

a condenser, comprising an inlet and an outlet, wherein the condenser inlet is operatively coupled to the outlet of the compressor;

a metering means, comprising an inlet and an outlet, wherein the inlet of the metering means is operatively coupled to the outlet of the condenser;

an evaporator, comprising an inlet, an outlet and an evaporative surface, wherein the evaporator inlet is operatively coupled to the outlet of the metering means and the outlet of the evaporator is operatively coupled to the inlet of the compressor;

a hot gas bypass means, comprising an inlet, an outlet, an open position and a closed position, wherein the hot gas bypass means inlet is operatively coupled to the outlet of the compressor and the hot gas bypass means outlet is operatively coupled to the inlet of the evaporator or to an inlet of a manifold, wherein:

the manifold comprises an inlet and a plurality of outlets, each outlet being operatively coupled to a different one of a plurality of inlets at different locations on the evaporative surface;

the hot gas bypass means also being operatively coupled to a controller;

one or more means for detecting the initiation of ice formation on the evaporative surface, each means being operatively coupled to the evaporative surface wherein if there is more that one, each is operatively coupled to a different location on the evaporative surface, and to the controller;

a controller operatively coupled to each means for detecting the formation of ice on the evaporative surface and to the hot gas by-pass means; and, a refrigerant that circulates from the compressor to the condenser to the metering means to the evaporator and back to the compressor in a refrigeration cycle.

2. The device of claim 1, wherein the means for detecting the formation of ice on the evaporative surface comprise(s) one or more lasers.

3. The device of claim 1, wherein the means for detecting the formation of ice on the evaporative surface comprise(s) one or more frost detectors.

4. The device of claim 1, wherein the means for detecting the formation of ice on the evaporative surface comprise(s) one or more first temperature sensing means coupled to one or more work-load temperature sensitive sub-assembly(ies) of the device.

5. The device of any one of claims 1, 2, 3 or 4, comprising one or more second temperature sensing means coupled to the evaporative surface, wherein if there is more than one, each is coupled to a different location on the evaporative surface, and to the controller.

6. The device of claim 1, wherein the means for detecting the formation of ice on the evaporative surface comprises one or more third temperature sensing means coupled to the evaporative surface wherein, if there is more than one, each is coupled to a different location on the evaporative surface.

7. The device of claim 1, wherein the metering means comprises a thermostatic expansion valve.

8. The device of claim 6, wherein the metering means comprises a thermostatic expansion valve.

9. The device of claim 8, wherein the thermostatic expansion valve comprises a temperature-sensing assembly.

10. The device of claim 9, wherein the temperature-sensing assembly comprises:

a double-walled container comprising an inner member and an outer member;

a first space disposed between the inner member and the outer member;

a second inner space circumscribed by the inner member;

an inlet disposed proximate to, in and through a first end, of the outer member, the inlet being operatively coupled to the outlet of the evaporator;

an outlet disposed proximate to, in and through a second end opposite the first end of the outer member, the outlet being operatively coupled to the inlet of the compressor;

a baffle disposed in the first space and extending from proximate to the first end of the outer member to proximate to the second end of the outer member;

a temperature sensing bulb disposed in the inner space, the temperature sensing bulb being operatively coupled to the thermostatic expansion valve; and, a thermal compound also disposed in the inner space, the thermal compound being in contact with the inner member and the temperature-sensing bulb.

11. The device of claim 1, wherein the hot gas by-pass means comprises a valve.

12. The device of claim 11, wherein the valve comprises a solenoid.

13. The device of claim any one of claims 1, 2, 3, 4 or 6, wherein each temperature-sensing means independently comprises a thermocouple or a thermistor.

14. The device of claim 1, wherein the controller comprises a microprocessor.

15. A method for performing a refrigeration cycle without ice build-up on the evaporative surface, comprising:

providing a compressor comprising an inlet and an outlet;

providing a condenser, comprising an inlet and an outlet, wherein the condenser inlet is operatively coupled to the outlet of the compressor;

providing a metering means, comprising an inlet and an outlet, wherein the inlet of the metering means is operatively coupled to the outlet of the condenser;

providing an evaporator, comprising an inlet, an outlet and an evaporative surface, wherein the evaporator inlet is operatively coupled to the outlet of the metering means and the outlet of the evaporator is operatively coupled to the inlet of the compressor;

providing a hot gas bypass means, comprising an inlet, an outlet, an open position and a closed position, wherein the hot gas bypass means inlet is operatively coupled to the outlet of the compressor and the hot gas bypass means outlet is operatively coupled to the inlet of the evaporator or to an inlet of a manifold, wherein:

the manifold comprises an inlet and a plurality of outlets, each outlet being operatively coupled to a different one of a plurality of inlets at different locations on the evaporative surface;

the hot gas bypass means also being operatively coupled to a controller;

providing one or more means for detecting ice formation on the evaporative surface, each such means being operatively coupled to the evaporative surface wherein, if there is more than one means, each is coupled to a different location on the evaporative surface, and to the controller;

providing one or more temperature sensing means coupled to the evaporative surface and operatively coupled to the controller;

providing a controller operatively coupled to each means for detecting the formation of ice on the evaporative surface, to each temperature sensing means and to the hot gas by-pass means; and, providing a refrigerant that circulates from the compressor to the condenser to the metering means to the evaporator and back to the compressor in a refrigeration cycle; wherein:

when the means for detecting ice formation on the evaporative surface detect(s) such ice formation, a signal is sent to the controller which in turn sends an open signal to the hot gas bypass means, the hot gas bypass means remaining open until the controller receives a signal from the temperature sensing means that is above a pre-set value, at which time the controller sends a close signal to the hot gas bypass means.

16. The method of claim 15, wherein the means for detecting the formation of ice on the evaporative surface comprise(s) one or more lasers.

17. The method of claim 15, wherein the means for detecting the formation of ice on the evaporative surface comprise(s) one or more frost detectors.

18. The method of claim 15, wherein the means for detecting the formation of ice on the evaporative surface comprise(s) one or more first temperature sensing means coupled to one or more work-load temperature sensitive sub-assembly(ies) of the device.

19. The method of claim 15, wherein each temperature sensing means comprises a thermocouple or a thermistor.

20. The method of claim 15, wherein the metering means comprises a thermostatic expansion valve.

21. The method of claim 15, wherein the hot gas by-pass means comprises a valve.

22. The method of claim 21, wherein the valve comprises a solenoid.

23. The method of claim 15, wherein the controller comprises a microprocessor.

24. The method of claim 15, wherein the hot gas by-pass means comprises a valve.

25. The method of claim 24, wherein the valve comprises a solenoid.

26. The method of claim 15, wherein each temperature-sensing means independently comprises a thermocouple or a thermistor.

27. The method of claim 15, wherein the controller comprises a microprocessor.

28. A method for performing a refrigeration cycle without ice build-up on the evaporative surface, comprising:

providing a compressor comprising an inlet and an outlet;

providing a condenser, comprising an inlet and an outlet, wherein the condenser inlet is operatively coupled to the outlet of the compressor;

providing a metering means, comprising an inlet and an outlet, wherein the inlet of the metering means is operatively coupled to the outlet of the condenser;

providing an evaporator, comprising an inlet, an outlet and an evaporative surface, wherein the evaporator inlet is operatively coupled to the outlet of the metering means and the outlet of the evaporator is operatively coupled to the inlet of the compressor;

providing a hot gas bypass means, comprising an inlet, an outlet, an open position and a closed position, wherein the hot gas bypass means inlet is operatively coupled to the outlet of the compressor and the hot gas bypass means outlet is operatively coupled to the inlet of the evaporator or to an inlet of a manifold, wherein:

the manifold comprises an inlet and a plurality of outlets, each outlet being operatively coupled to a different one of a plurality of inlets at different locations on the evaporative surface;

the hot gas bypass means also being operatively coupled to a controller;

providing one or more temperature sensing means coupled to the evaporative surface, wherein if there is more than one, each is coupled to a different location on the evaporative surface;

providing a controller operatively coupled to each temperature sensing means and to the controller; wherein:

each temperature-sensing means measures a temperature at its location on the evaporative surface and sends a signal corresponding to that temperature to the controller wherein, if the signal is at or below a pre-selected first set point temperature, the controller sends an open signal to the hot gas bypass means, the hot gas bypass means remaining open until the controller receives a signal from the temperature-sensing means than is above a pre-selected second set point temperature, at which time the controller sends a close signal to the hot gas bypass means.

29. The method of claim 28, wherein the metering means comprises a thermostatic expansion valve.

30. The method of claim 29, wherein the thermostatic expansion valve further comprises a temperature-sensing assembly.

31. The method of claim 30, wherein the temperature-sensing assembly comprises:

a double-walled container comprising an inner member and an outer member;

a first space disposed between the inner member and the outer member;

a second inner space circumscribed by the inner member;

an inlet disposed proximate to, in and through a first end of the outer member, the inlet being operatively coupled to the outlet of the evaporator;

an outlet disposed proximate to, in and through a second end opposite the first end of the outer member, the outlet being operatively coupled to the inlet of the compressor;

a baffle disposed in the first space and extending from proximate to the first end of the outer member to proximate to the second end of the outer member;

a temperature sensing bulb disposed in the inner space, the temperature sensing bulb being operatively coupled to the thermostatic expansion valve; and, a thermal compound also disposed in the inner space, the thermal compound being in contact with the inner member and the temperature-sensing bulb.

* * * * *